US012024326B2

(12) United States Patent
Nakamoto et al.

(10) Patent No.: US 12,024,326 B2
(45) Date of Patent: Jul. 2, 2024

(54) BAG PROCESSING SYSTEM

(71) Applicant: PACRAFT Co., Ltd., Tokyo (JP)

(72) Inventors: Kakue Nakamoto, Iwakuni (JP); Masaru Yoshikado, Iwakuni (JP); Kenji Kawamura, Iwakuni (JP); Yuuki Matsumura, Iwakuni (JP); Keiko Nagata, Iwakuni (JP)

(73) Assignee: PACRAFT CO., LTD., Tokyo (JP)

( * ) Notice: Subject to any disclaimer, the term of this patent is extended or adjusted under 35 U.S.C. 154(b) by 0 days.

(21) Appl. No.: 17/869,282

(22) Filed: Jul. 20, 2022

(65) Prior Publication Data

US 2023/0025364 A1 Jan. 26, 2023

(30) Foreign Application Priority Data

Jul. 26, 2021 (JP) ..... 2021-121975

(51) Int. Cl.

| | |
|---|---|
| ***B65B 43/60*** | (2006.01) |
| ***B65B 1/04*** | (2006.01) |
| ***B65B 3/04*** | (2006.01) |
| ***B65B 43/46*** | (2006.01) |

(52) U.S. Cl.

CPC ..... *B65B 43/465* (2013.01); *B65B 1/04* (2013.01); *B65B 3/04* (2013.01); *B65B 43/60* (2013.01)

(58) Field of Classification Search

CPC ..... B65B 1/04; B65B 3/04; B65B 43/465; B65B 43/60; B65B 43/50; B65B 43/42; B65B 57/16

See application file for complete search history.

(56) References Cited

U.S. PATENT DOCUMENTS 4,900,999 A 2/1990 Shibata et al.
6,390,272 B1 * 5/2002 Tsutsui ..... B65B 43/52 198/803.14

(Continued)

FOREIGN PATENT DOCUMENTS

EP 1035023 A1 9/2000
EP 3556668 A1 10/2019

(Continued)

OTHER PUBLICATIONS

Extended European Search Report dated Jan. 26, 2023, issued in corresponding European Patent Application No. 22187002.5 (8 pgs.).

(Continued)

*Primary Examiner* — Nicolas A Arnett

(74) *Attorney, Agent, or Firm* — Pillsbury Winthrop Shaw Pittman, LLP

(57) ABSTRACT

A bag processing system includes: a conveyance mechanism which includes: a plurality of support devices being able to support and release bags; and a conveyance drive device moving the plurality of support devices intermittently; a liquid introduction device which introduces a liquid into the bags supported by the plurality of support devices; and a conveyance control device which controls the conveyance drive device, wherein: the conveyance drive device moves the plurality of support devices in such a manner that the plurality of support devices exhibit same acceleration-deceleration behavior between each other, and the conveyance control device controls the conveyance drive device to accelerate or decelerate the plurality of support devices in such a manner that shaking of the liquid in the bags is reduced.

8 Claims, 7 Drawing Sheets

(56) References Cited

U.S. PATENT DOCUMENTS

| | | | | |
|---|---|---|---|---|
| 7,597,187 | B2 * | 10/2009 | Bausenwein | B41F 13/00 198/619 |
| 11,091,284 | B2 * | 8/2021 | Nakamoto | B65B 43/52 |
| 2002/0144880 | A1 * | 10/2002 | Ikemoto | B65G 37/005 198/469.1 |
| 2009/0308031 | A1 * | 12/2009 | Koga | B65B 43/465 53/570 |
| 2013/0152516 | A1 * | 6/2013 | Sammons | B65G 54/02 53/562 |
| 2018/0016045 | A1 * | 1/2018 | Nakamoto | B65B 3/04 |
| 2019/0233152 | A1 * | 8/2019 | Nakamoto | B65B 51/32 |
| 2019/0322402 | A1 * | 10/2019 | Matsumura | B65B 57/10 |

FOREIGN PATENT DOCUMENTS

| | | | |
|---|---|---|---|
| JP | 5-17082 | B2 | 3/1993 |
| JP | 5-28169 | Y2 | 7/1993 |
| JP | 6-156440 | A | 6/1994 |
| JP | 2000-318834 | A | 11/2000 |
| JP | 2002-302227 | A | 10/2002 |
| JP | 3386932 | B2 | 1/2003 |
| JP | 2009-298418 | A | 12/2009 |
| JP | 4989866 | B2 | 5/2012 |
| JP | 5563511 | B2 | 6/2014 |
| JP | 2018-008726 | A | 1/2018 |
| KR | 10-2012-0115936 | A | 10/2012 |
| KR | 10-1568996 | B1 | 11/2015 |

OTHER PUBLICATIONS

Notice dated Mar. 5, 2024, advising that a Submission of Information was submitted to the Japan Patent Office on Feb. 9, 2024, by a third party in corresponding Japanese Patent Application No. 2021-121975 with English translation (73 pgs.).

* cited by examiner

BAG PROCESSING SYSTEM

CROSS-REFERENCE TO RELATED APPLICATIONS

This application is based upon and claims the benefit of priority from Japanese Patent Application No. 2021-121975, filed on Jul. 26, 2021; the entire contents of which are incorporated herein by reference. Further, the entire contents of Japanese patent application Nos. 2008-152584, 4-93938, 2000-36276 and 2001-106529 and Japanese utility model application No. 62-024902 (corresponding to Japanese patent application publication Nos. 2009-298418, 6-156440, 2000-318834 and 2002-302227 and Japanese examined utility model application publication No. 5-28169, respectively) are incorporated herein by reference.

TECHNICAL FIELD

The present disclosure relates to a bag processing system.

BACKGROUND ART

A bag processing system (see Japanese patent application publication No. 2018-8726) is known that sequentially conveys many bags and intermittently stops each bag at a plurality of stations provided along the conveyance route, to perform various processes (such as a mouth opening process of a bag, a content introduction process of a bag, and a sealing process of a bag).

SUMMARY OF INVENTION

In cases where a liquid is introduced into a bag in a bag processing system, the liquid inside a bag is shaken while the bag is conveyed. If the liquid inside a bag is shaken violently during the bag conveyance, the liquid may adhere to the mouth portion of the bag (e.g., at the part to be sealed) or may fly out of the bag.

In particular, high-speed bag transfer is often required to improve productivity, but when the acceleration/deceleration speed of bag transfer increases, a larger inertial force acts on a liquid inside a bag, so that the liquid tends to shake more violently.

If a liquid inside a bag is shaken violently and consequently adheres to the part to be sealed, the sealing process may not be properly performed and product bags having sealing defects are more likely to be produced. Further, if a liquid is splashed outside from a bag, the splashed liquid may contaminate the processing system or may cause insufficient amount of liquid to be introduced into the bag.

The present disclosure has been contrived in view of the above-mentioned circumstances, and an object of the present invention is to provide a technical solution which is advantageous in suppressing the shaking of a liquid in a bag.

One aspect of the present disclosure is directed to a bag processing system comprising: a conveyance mechanism which includes: a plurality of support devices being able to support and release bags; and a conveyance drive device moving the plurality of support devices intermittently; a liquid introduction device which introduces a liquid into the bags supported by the plurality of support devices; and a conveyance control device which controls the conveyance drive device, wherein: the conveyance drive device moves the plurality of support devices in such a manner that the plurality of support devices exhibit same acceleration-deceleration behavior between each other, and the conveyance control device controls the conveyance drive device to accelerate or decelerate the plurality of support devices in such a manner that shaking of the liquid in the bags is reduced.

At least a part of a movement path of the bags supported by the plurality of support devices may include a non-straight path, and the conveyance control device may control the conveyance drive device to accelerate or decelerate the plurality of support devices during the bags moving in at least a part of the non-straight path in such a manner that shaking of the liquid in the bags is reduced.

The bag processing system may comprise a sway suppression guide which suppresses sway due to centrifugal force of the bags supported by the plurality of support devices.

The plurality of support devices may include a plurality of holding units which hold the bags, the conveyance control device may control the conveyance drive device to intermittently stop the plurality of support devices at a plurality of stations in sequence, and three or more support devices may stop at each of the plurality of stations at a time.

According to the present disclosure, it is advantageous in suppressing the shaking of a liquid in a bag.

DESCRIPTION OF EMBODIMENTS

An embodiment of the present disclosure will be described with reference to the drawings. First, a typical example of a bag processing system to which a technical solution of the present disclosure can be applied is described with reference to FIGS. 1 through 5, and then a specific example of a technical solution for controlling the shaking of a liquid in a bag during the bag conveyance is described with reference to FIGS. 6 and 7.

Figure 1:
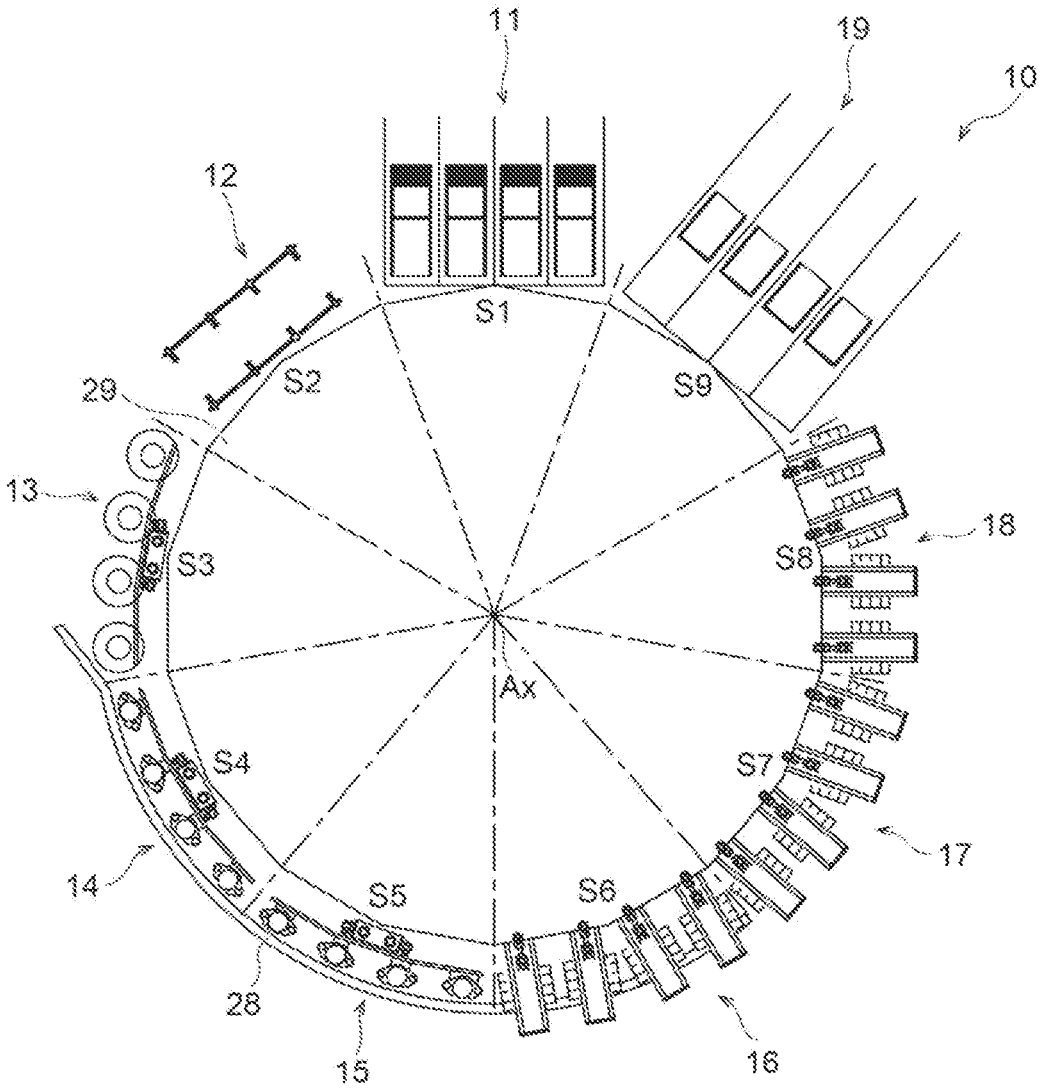
FIG. 1 is a plan view of a schematic configuration of an example of a bag processing system.

FIG. 1 is a plan view of a schematic configuration of an example of a bag processing system 10. In FIG. 1, only a part of the bag processing system 10 is shown and the illustration of devices that are installed above a rotation table 29, for example, is omitted. An example of the devices installed above the rotation table 29 is described later with reference to FIGS. 2 and 3.

Figure 2:
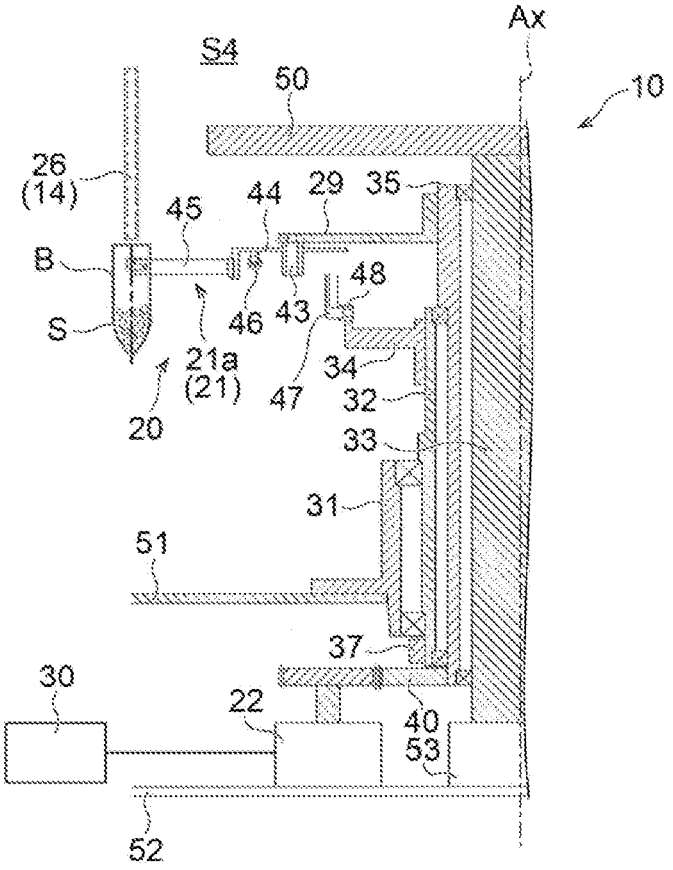
FIG. 2 shows a partial cross-sectional view of an example of a liquid introduction station of a bag processing system.

The bag processing system 10 comprises: the rotation table 29 that rotates intermittently around the central axis (i.e., the rotation axis Ax); and a plurality of support units (which are not shown in FIG. 1; see reference numeral "21"

in FIG. 2) attached to the outer periphery part of the rotation table 29 at equal intervals (at equal angular intervals).

The rotation table 29 repeatedly rotates and stops at predetermined angles. With the intermittent rotation of the rotation table 29, the support units move intermittently along the circular conveyance path. The supporting units stop at a bag feeding station S1 to a bag release station S9 in sequence, along with bags which the supporting units support, while the supporting units perform one rotation along the conveyance path.

Therefore, a bag supported by a support device of each support unit moves along the circular path (i.e., a non-straight path) in response to the intermittent rotation of the rotation table 29 and intermittently stops at the bag feeding station S1 to the bag release station S9. The following processes are performed at the stations S1 to S9, respectively.

In the bag feeding station S1, a conveyor magazine-type bag feeding device 11 that supplies bags to the support units is located, and the bag feeding step is performed by the bag feeding device 11. A bag fed from the bag feeding device 11 is held at both edge portions near the mouth portion by a support unit that intermittently stops at the bag feeding station S1 and is consequently hung with the mouth portion facing up. In the example shown in FIG. 1, each support unit includes four gripper pairs functioning as support devices, and the bag feeding device 11 supplies four bags at a time to the respective support units and the four bags are gripped by the four gripper pairs, respectively.

A mouth opening device 12 is located in a mouth opening station S2 and a mouth opening step in which the mouth portions of bags supported by a support unit are opened is performed by the mouth opening device 12. The mouth opening device 12 includes a pair of suction cups that can move closer to or further away from each other. The mouth opening device 12 shown in FIG. 1 includes four pairs of suction cups and can open the mouth portions of four bags held by each support unit (i.e., by the four gripper pairs) at a time.

In a solid content feeding station S3, a solid content feeding device 13 having hoppers that lift and lower is located and a solid content feeding step in which contents (in particular, solid contents (see sign "S" in FIG. 2)) are fed into the inside of bags is performed by the solid content feeding device 13. Contents supplied from a solid content supply section (not shown in the drawings) are guided by the hoppers to be fed into the inside of bags through the mouth portions.

In a liquid introduction station S4, a liquid introduction device 14 having injection nozzles that lift and lower is located and a liquid introduction step in which a content (in particular, a liquid) is introduced into the inside of bags is performed by the liquid introduction device 14. The injection nozzles are positioned in the evacuation position where the entire injection nozzles are positioned outside bags and are positioned in the introduction position where the tips of the injection nozzles are positioned inside the bags, and in the introduction position, spray a liquid toward the inside of the bags.

In a degassing station S5, a steam degassing device 15 having blowing nozzles is located and a degassing step in which a steam is blown into the inside of bags is performed by the steam degassing device 15. A steam supplied from a steam supply section (not shown in the drawings) is spouted from the blowing nozzles to be blown into the inside of bags. At the degassing station S5, the distance between grippers is widened to tense up the mouth portions of bags and reduce the opening area of the mouth portions.

In a first sealing station S6, a first sealing device 16 having first sealing heating units (e.g., pairs of heating plates) that open and close is located and a first sealing step in which bags (in particular, the mouth portions) are sealed is performed by the first sealing device 16.

In a second sealing station S7, a second sealing device 17 having second sealing heating units (e.g., pairs of heating plates) that open and close is located and a second sealing step in which bags (in particular, the mouth portions) are sealed is performed by the second sealing device 17.

In a cooling station S8, a cooling device 18 having cooling units (e.g., pairs of cooling plates) that open and close is located and a sealed-part cooling step in which bags (in particular, the sealed parts) are cooled is performed by the cooling device 18.

In the bag release station S9, a bag release device 19 is located and a product-bag release step in which bags in which contents are enclosed (i.e., product bags) are released is performed by the bag release device 19. At the bag release station S9, when the gripping parts (i.e., holding units) of each gripper pair are opened, bags (product bags) are released from the gripper pairs and fall under the influence of gravity to land on a conveyor of the bag release device 19 and then are conveyed downstream by the conveyor.

In the liquid introduction station S4, the degassing station S5 and the first sealing station S6, a sway suppression guide 28 is provided. The sway suppression guide 28 physically suppresses the movement (sway) of bags supported by a plurality of gripper pairs due to centrifugal force. Thus, each bag conveyed by a gripper pair is restrained from swaying due to centrifugal force by the sway suppression guide 28, from the time when a liquid is introduced by the liquid introduction device 14 until the mouth portion is sealed by the first sealing device 16. By suppressing the sway of a liquid in bags by means of the sway suppression guide 28, the liquid is effectively prevented from adhering to the mouth portions (e.g., the parts which are to be sealed) of the bags and from flying out of the bags.

The sway suppression guide 28 shown in FIG. 1 is fixedly installed on the outer side, compared to the movement path (i.e., a circular path) of the gripper pairs and bags, in terms of the radial direction of the rotation table 29 (i.e., in terms of the direction of centrifugal force action), and can contact the side surfaces (in particular, the outside surfaces in terms of the radial direction) of bags to suppress the sway of the bags. This sway suppression guide 28 may be provided in a position where the sway suppression guide 28 is always in contact with bags moving along the path, or alternatively, may be provided in a position where the sway suppression guide 28 is not in contact with bags that are not swaying in the radial direction but is in contact with bags that are swaying in the radial direction.

The sway suppression guide 28 is not limited to the structure shown in FIG. 1. For example, two sway suppression guides 28 may be installed on the radially outer side and the radially inner side of bags moving along the path, respectively. In this case, not only the swaying (movement) of bags outward in the radial direction, but also the swaying of bags inward in the radial direction can be suppressed by the sway suppression guides 28.

Further, the sway suppression guide 28 may be installed in a position where the sway suppression guide 28 supports, from below, bags moving along the path. For example, a sway suppression guide 28 having an inclined surface on which a bag is placed while the inclined surface is in contact with the outer radial side surface of the bag and a sway suppression guide 28 having an inclined surface on which a bag is placed while the inclined surface is in contact with the inner radial side surface of the bag may be provided. In this case, bags move from one to the other of adjacent stations in a state where the bags are placed on the inclined surfaces of the two sway suppression guides 28 in such a manner that the sway of the bags in the radial direction is reduced.

Further, the sway suppression guide 28 may be installed in such a manner that the sway suppression guide 28 is movable with a bag. For example, while a bag moves intermittently between adjacent stations, the sway suppression guide 28 may move intermittently between the adjacent stations together with the bag. In this case, the sway suppression guide 28 may return to the upstream station while the bag is intermittently stopped at the downstream station and after that, the sway suppression guide 28 may intermittently move to the downstream station together with a bag which is newly arranged at the upstream station.

For example, in the bag processing system 10 shown in FIG. 1, one or more first sway suppression guides 28 that move back and forth between the liquid introduction station S4 and the degassing station S5 and one or more second sway suppression guides 28 that move back and forth between the degassing station S5 and the first sealing station S6 may be provided. In this case, a bag moving from the liquid introduction station S4 to the degassing station S5 can move intermittently together with the first sway suppression guide 28. Further, a bag moving from the degassing station S5 to the first sealing station S6 can move intermittently together with the second sway suppression guide 28.

Further, the sway suppression guide 28 may be provided integrally with the gripper pairs. For example, a sway suppression guide 28 that is installed integrally with the gripping part of each gripper and extends downward (i.e., vertically) from the gripping part may be provided. In this case, the sway of the part of a bag that is located below the gripping part can be reduced by the sway suppression guide 28.

The sway suppression guide 28 which is provided integrally with the gripping part of each gripper, may be provided to open and close together with the gripping part. In this case, the sway suppression guide 28 may grip a bag (e.g., a side edge portion (a sealed portion)) to compress the bag or may restrict the radial outward movement and the radial inward movement of a bag without compressing the bag. In cases where the sway suppression guide 28 pinches a bag in a compressive manner, the bag is supported also by the sway suppression guide 28 and consequently it is possible to reduce the sway of the bag in the radial direction more reliably. On the other hand, in cases where a bag is positioned between the sway suppression guide 28 located on the radially inner side of the bag and the sway suppression guide 28 located on the radially outer side of the bag but the bag is not compressed by these sway suppression guides 28, it is possible to prevent the gripping force of the gripping parts (i.e., the force applied to a bag from the gripping parts) from decreasing and to prevent the volume inside the bag from being reduced by the sway suppression guides 28.

Various devices which the bag processing system 10 comprises may be driven under the control of a control device (not shown in the drawings) or may be driven independently without being controlled by the control device. Two or more devices driven under the control of the control device may be driven in coordination with each other, with the drive timing coordinated by the control device.

Figure 3:
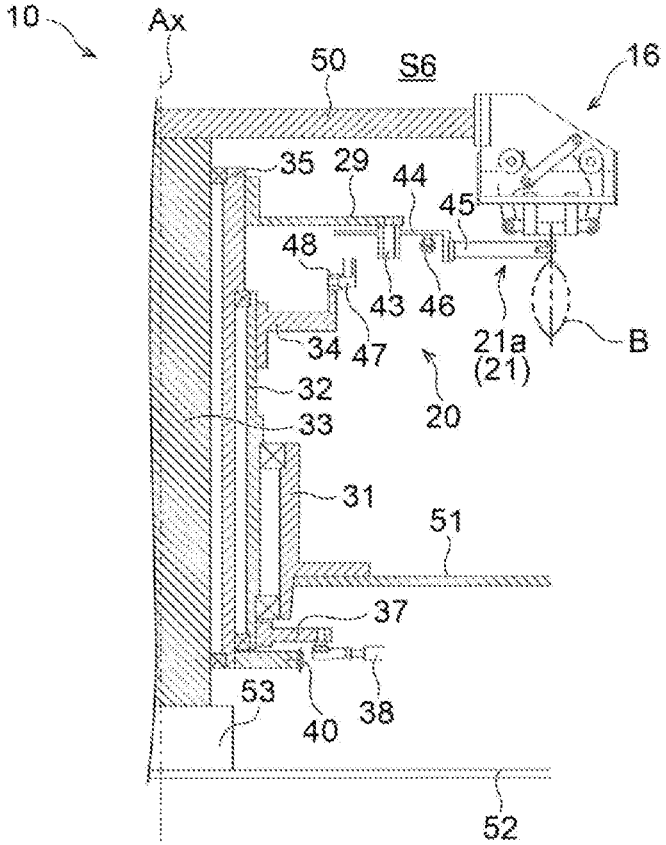
FIG. 3 shows a partial cross-sectional view of an example of a first sealing station of a bag processing system.

FIG. 2 shows a partial cross-sectional view of an example of the liquid introduction station S4 of the bag processing system 10. FIG. 3 shows a partial cross-sectional view of an example of the first sealing station S6 of the bag processing system 10.

In the bag processing system 10 shown in FIGS. 2 and 3, a tubular stand 31 is fixedly installed on a first mount 51, and a rotation support shaft 35 is provided inside the stand 31 via a hollow shaft 32 in such a manner that the rotation support shaft 35 can rotate freely. More specifically, the hollow shaft 32 is supported by the inside of the stand 31 via bearings in such a manner that the hollow shaft 32 can rotate freely, and the rotation support shaft 35 is supported by the inside of the hollow shaft 32 via bearings in such a manner that the rotation support shaft 35 can rotate freely.

A drive gear 40 is fixed to the lower end of the rotation support shaft 35. The drive gear 40 is connected to a gear of a conveyance drive device 22 (in the present example, the conveyance drive device 22 supported fixedly by a second mount 52) installed between the first mount 51 and the second mount 52. The conveyance drive device 22 in the present example transmits rotary power to the drive gear 40, and the power is then transmitted to each gripper pair 21*a* (each support device) of the support unit 21 via the drive gear 40, the rotation support shaft 35 and the rotation table 29.

Under the control of a conveyance control device 30, the conveyance drive device 22 intermittently moves the plurality of gripper pairs 21*a* that are attached to the rotation table 29, and the plurality of gripper pairs 21*a* move in an integrated manner to exhibit the same acceleration-deceleration behavior as each other. In other words, the conveyance control device 30 controls the conveyance drive device 22 to intermittently convey the plurality of gripper pairs 21*a* in an integrated manner to stop the plurality of gripper pairs 21*a* intermittently at the plurality of stations S1 to S9 in sequence. The conveyance control device 30 may be provided as a part of a control device that controls other devices which the bag processing system 10 comprises.

The rotation support shaft 35 intermittently rotates integrally with the drive gear 40. The hollow shaft 32 and the rotation support shaft 35 rotate independently of each other around the common rotation axis Ax.

The second mount 52 is located downward and away from the first mount 51. In the space between the first mount 51 and the second mount 52, a lever 37 and a rod 38, in addition to the conveyance drive device 22 and the drive gear 40, are installed.

An entire circumference cam 34 is attached to the upper end part of the hollow shaft 32. The entire circumference cam 34 is provided to be able to freely slide on the hollow shaft 32 in the up-down direction and is engaged with the hollow shaft 32 in the rotation direction, so that the entire circumference cam 34 rotates about the rotation axis Ax together with the hollow shaft 32. The entire circumference cam 34 includes: a disk-shaped portion having a substantial disk shape; and a cylindrical portion extending upward from the outer periphery part of the disk-shaped portion, and the upper surface of the cylindrical portion acts as a cam surface. The entire circumference cam 34 is lifted and lowered by a lifting device, which is not shown in the drawings, to determine the position of the entire circumference cam 34 in the height direction (i.e., the up-down direction). The lever 37 is fixed to the lower end of the hollow shaft 32. A tip end of the rod 38 which is advanced and retracted by a cam which is not shown in the drawings, is connected to the lever 37 in such a manner that the rod 38 can rotate freely. By advancing and retracting the rod 38, the hollow shaft 32 and the entire circumference cam 34 rotate, together with the lever 37, in the forward direction and the reverse direction around the rotation axis Ax.

The rotation table 29 is attached to the upper end portion of the rotation support shaft 35, and the rotation table 29 is supported by the rotation support shaft 35. The rotation table 29 is provided to be able to freely slide on the rotation support shaft 35 in the axial direction, which is along the rotation axis Ax, within a predetermined range, and is engaged with the rotation support shaft 35 in the rotation direction around the rotation axis Ax, so that the rotation table 29 rotates, together with the rotation support shaft 35, about the rotation axis Ax. The rotation support shaft 35 rotates intermittently around the rotation axis Ax and consequently the rotation table 29 rotates intermittently around the rotation axis Ax.

A plurality of support units 21 are attached to the periphery of the rotation table 29 at equal angular intervals, and the angular interval between adjacent support units 21 is the same as the angle of one intermittent rotation of the rotation table 29.

A gripper pair 21*a* of each support unit 21 can support and release a bag B. Each support unit 21 shown in FIG. 2 has a plurality of gripper pairs 21*a* (in the example shown in FIGS. 1 and 2, four gripper pairs 21*a*), and a plurality of bags B (in the example shown in FIGS. 1 and 2, four bags) are gripped by the respective gripper pairs 21*a*. Thus, at each of the above-mentioned plurality of stations S1 to S9, four bags B gripped by the four gripper pairs 21*a* included in a corresponding support unit 21 are stopped at a time.

As in a gripper pair described in Japanese patent application publication No. 2009-298418, each gripper pair 21*a* includes: a pair of left and right swinging levers 44 attached to a support shaft 43 fixed to the rotation table 29 so as to be able to rotate freely (in FIGS. 2 and 3, only one swinging lever 44 is shown); cylindrical gripper arms 45 fixed to the tip ends of respective swinging levers 44; and gripping parts attached to the tip ends of respective gripper arms 45. Air cylinders functioning as driving sources for performing the opening and closing of the gripping parts are located inside the respective gripper arms 45.

The two swinging levers 44 included in each gripper pair 21*a* are inwardly energized by a tension spring 46 to receive elastic force from the tension spring 46 in the direction such that the two swinging levers 44 approach each other.

A roller 48 is placed on the cam surface of the entire circumference cam 34 and is supported by an L-shaped lever 47 in such a manner that the roller 48 rotates freely. The roller 48 rolls and moves on the cam surface of the entire circumference cam 34. The L-shaped lever 47 and the roller 48 are a part of the mechanism that opens and closes two swinging levers 44 (and thus that opens and closes two gripper arms 45 and two gripping parts), this mechanism has the same structure and the same function as the mechanism described in Japanese examined utility model application publication No. 5-28169, and the mechanism are attached to the rotation table 20 to correspond to each gripper pair 21*a*. As the rotation table 29 and the entire circumference cam 34 rotate relative to each other, the rollers 48 roll and move on the cam surface of the entire circumference cam 34. In doing so, if there is a height difference in the cam surface on which a roller 48 rolls, an L-shaped lever 47 oscillates and two swinging levers 44 (and thus two gripper arms 45 and two gripping parts) open or close in the horizontal plane to change the interval between the two gripping parts.

The plurality of gripper pairs 21*a* included in each support unit 21 perform the same actions as each other to exhibit the same behavior as each other, and thus operate in an integrated manner.

When the rotation table 29 rotates intermittently, the entire circumference cam 34 also follows the rotation table 29 to rotate in the forward direction by the same angle as the rotation table 29; therefore, the relative rotation angle between the rotation table 29 and the entire circumference cam 34 is zero (0) and consequently no relative rotation substantially occurs between the rotation table 29 and the entire circumference cam 34. On the other hand, when the rotation table 29 stops intermittently, the entire circumference cam 34 rotates in the reverse direction to return to its original position and consequently a relative rotation substantially occurs between the rotation table 29 and the entire circumference cam 34. This is the same as the wrapping machine described in Japanese examined utility model application publication No. 5-28169.

In the above-described bag processing system 10, as in the technique disclosed in Japanese patent application publication No. 2009-298418, air cylinders are used as driving sources for performing the opening and closing of gripping parts of a gripper pair 21*a* and the air cylinders are located inside gripper arms 45. However, the opening and closing of gripping parts of a gripper pair 21*a* may be performed by an opening-closing drive mechanism installed on a proper region on the first mount 51 or the second mount 52 (for example, in the bag feeding station S1 or the bag release station S9), as described in Japanese patent application publication No. 6-156440.

A gripper described in Japanese patent application publication No. 6-156440 comprises: a pair of left and right swinging levers attached to a table which intermittently rotates; gripper arms having base portions fixed to the respective swinging levers; and gripping parts which are provided at the tip ends of the respective gripper arms and are arranged to face inwardly to opposite to each other, wherein the gripping parts each includes: a fixed side gripping piece having a gripping surface directed in a radiation direction; and a movable side gripping piece attached to the tip end of a gripper arm to rotate freely. This gripper is similar to the gripper of a device described in Japanese patent application publication No. 2009-298418. On the gripper arm, a connecting mechanism part that transmits the power from the opening-closing drive mechanism to the movable side gripping piece and a compression spring which constantly forces the movable side gripping piece in a closed direction are installed. A cylindrical member (a roller) is attached to a passive member, and when a prod member of the opening-closing drive mechanism moves forward to press the cylindrical member in the radiation direction of the table, the movable side gripping piece opens, and when the prod member moves backward, the movable side gripping piece is closed by the force of the compression spring.

The bag processing system 10 further comprises: a fixed support shaft 33 attached fixedly to the second mount 52 via a support fixed member 53; and a fixed support member 50 attached fixedly to the fixed support shaft 33. The fixed support shaft 33 extends in the height direction to penetrate the inside of the rotation support shaft 35 and is located on the rotation axis Ax. Bearings are provided between the rotation support shaft 35 and the fixed support shaft 33. Even when the rotation support shaft 35 (and thus the rotation table 29) rotates about the rotation axis Ax, the fixed support shaft 33 does not rotate.

The disk-shaped fixed support member 50, which is supported by the fixed support shaft 33, is attached to the top of the fixed support shaft 33 to be positioned above the rotation table 29 and the plurality of gripper pairs 21*a*. As described above, even when the rotation support shaft 35 supporting the rotation table 29 rotates, the fixed support shaft 33 supporting the fixed support member 50 does not rotate; therefore, even when the rotation table 29 rotates, the fixed support member 50 does not rotate.

Any devices may be attached to the fixed support member 50, and any devices provided for each station may be supported by the fixed support member 50. For example, in the example shown in FIG. 2, a nozzle drive device (not shown in the drawings) that lifts and lowers an injection nozzle 26 of the liquid introduction device 14 may be supported by the fixed support member 50. Further, in the example shown in FIG. 3, the first sealing device 16 is supported by the fixed support member 50.

Figure 4:
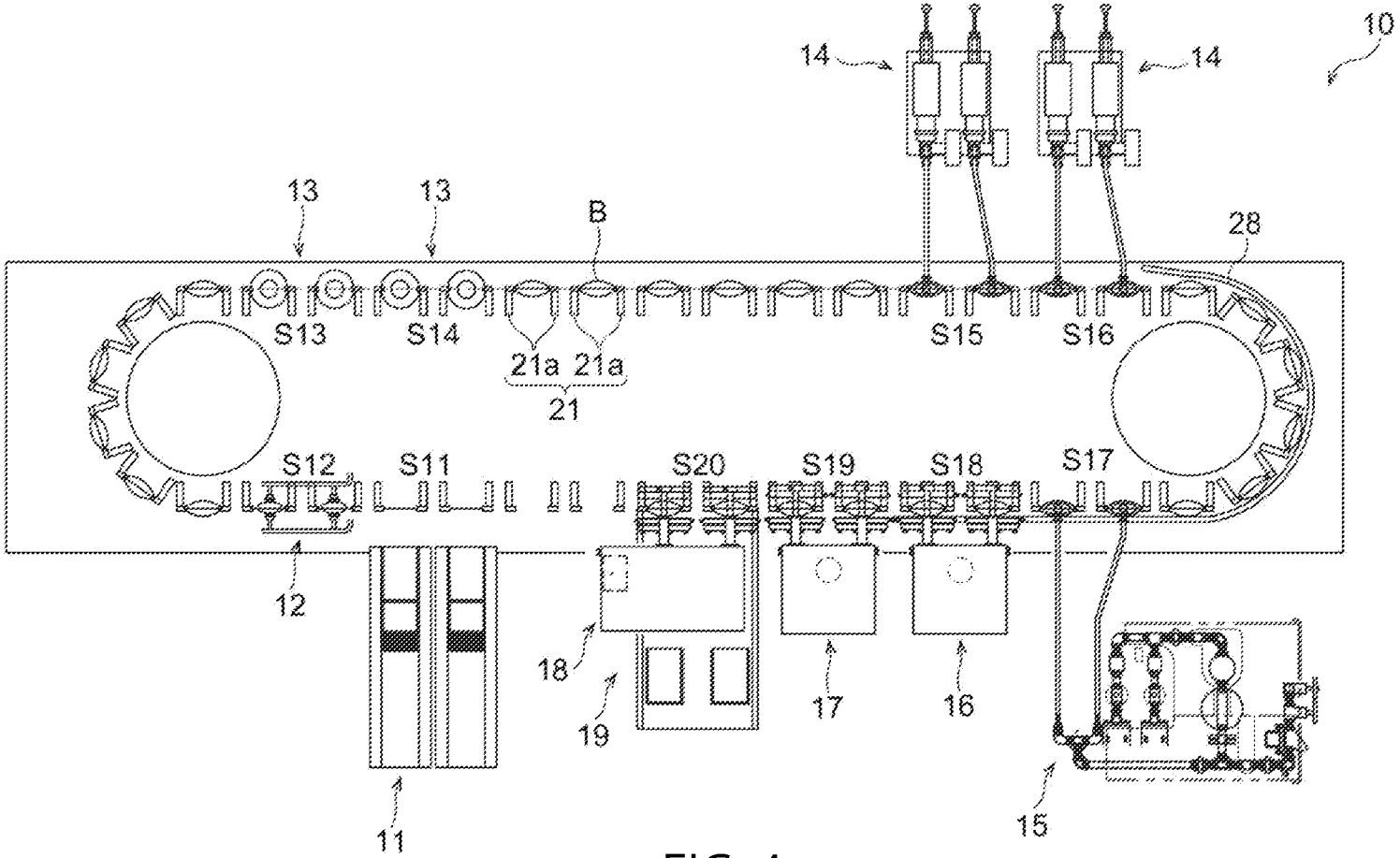
FIG. 4 is a plan view of a schematic configuration of another example of a bag processing system.
Figure 5:
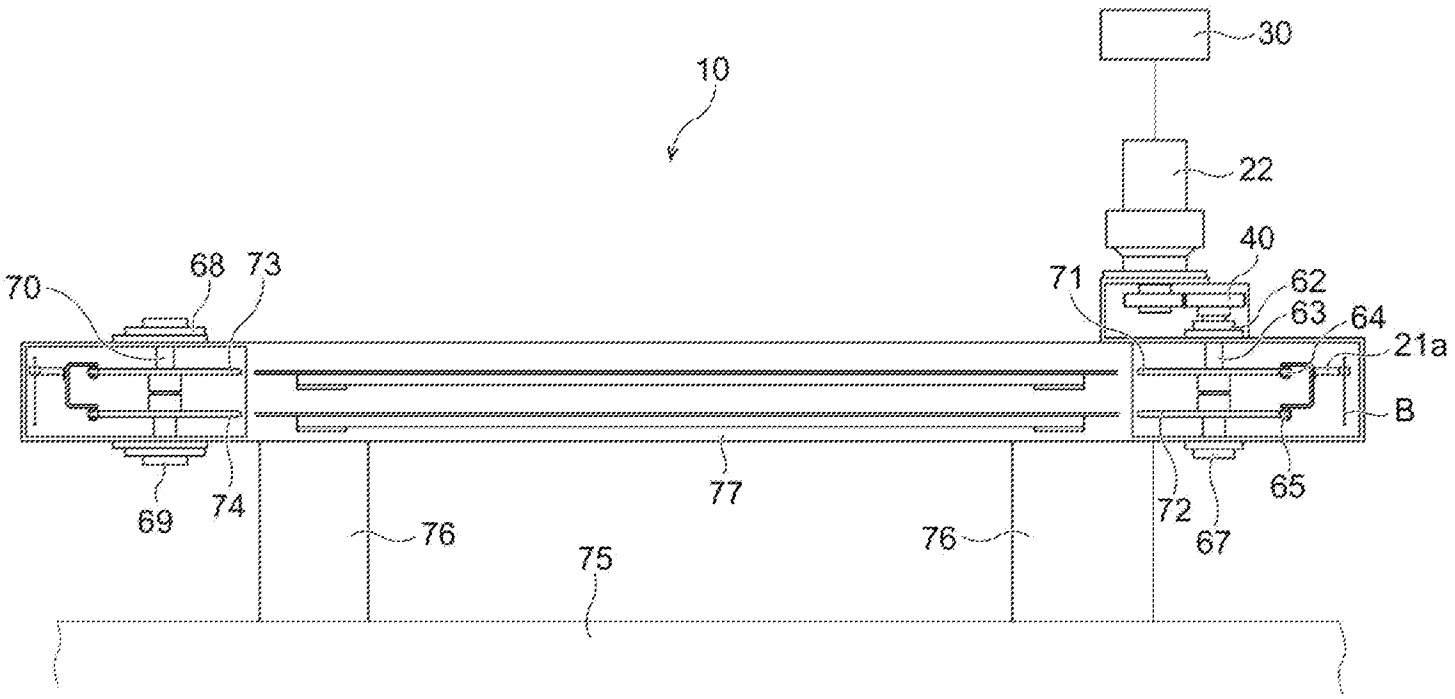
FIG. 5 is a side view of a conveyance device of the bag processing system shown in FIG. 4.

FIG. 4 is a plan view of a schematic configuration of another example of the bag processing system 10. FIG. 5 is a side view of a conveyance device of the bag processing system 10 shown in FIG. 4. Among the components of the bag processing system 10 shown in FIGS. 4 and 5, elements identical or corresponding to those shown in FIGS. 1 to 3 described above are marked with the same signs and their detailed descriptions are omitted.

The bag processing system 10 shown in FIGS. 4 and 5 also has a plurality of support units 21. Each support unit 21 has a plurality of gripper pairs 21*a* (in the example shown in FIG. 4, two gripper pairs 21*a*) which are each supported at equal intervals by endless conveyor chains (i.e., an upper conveyor chain 64 and a lower conveyor chain 65). At each of the stations S1 to S9, two bags B gripped by the two gripper pairs 21*a* included in a corresponding support unit 21 are stopped at a time.

The conveyance drive device 22 is provided as a drive source for moving the gripper pairs 21*a* along the conveyance direction of bags B. The chains 64 and 65 are rotated by the conveyance drive device 22, so that the plurality of gripper pairs 21*a* move. Although the basic structure of the conveyance device of the bag processing system 10 is substantially the same as that of the conveyance device described in Japanese patent application publication No. 2000-318834, it is briefly described below.

The conveyance device is installed on a mount 75 via support members 76. The conveyance device of the present example comprises: a frame 77 attached to the support members 76; a support shaft 63 attached to the frame 77 via a bearing 62 and a bearing 67 in such a manner that the support shaft 63 is able to rotate freely; a support shaft 70 attached to the frame 77 via a bearing 68 and a bearing 69 in such a manner that the support shaft 70 is able to rotate freely; sprockets 71 to 74 fixed to the support shaft 63 and the support shaft 70; the endless upper conveyor chain 64 supported by the upper sprockets 71, 73; and the endless lower conveyor chain 65 supported by the lower sprockets 72, 74.

Many gripper pairs 21*a* (the support units 21) are attached to the upper conveyor chain 64 and the lower conveyor chain 65 at equal intervals (pitch=p) while the gripper pairs 21*a* (the support units 21) face outward. The power output from the conveyance drive device 22 is transmitted to the support shaft 63 via the drive gear 40 and rotates the conveyor chains 64 and 65 via the sprockets 71, 72, so that each gripper pair 21*a* is conveyed along the circular path. The details of the attachment structure and the operation of the gripper pairs 21*a* with respect to the conveyor chains 64 and 65 are described in Japanese patent application publication No. 2002-302227.

In the example shown in FIGS. 4 and 5 described above, when the conveyance drive device 22 is driven under the control of the conveyance control device 30, each gripper pair 21*a* moves intermittently along the circular path and stops intermittently at stations S11 to S20.

In the stations S11 to S20 shown in FIG. 4, the same processes as those performed in the stations S1 to S9 shown in FIG. 1 described above are performed.

Specifically, at the bag feeding station S11, the bag feeding step is performed by the bag feeding device 11 in such a manner that bags B are fed to each support unit 21 and the bags are gripped by the gripper pairs 21*a*. At the mouth opening station S12, the mouth opening step is performed by the mouth opening device 12 in such a manner that the mouth portions of the bags B gripped by the respective gripper pairs 21*a* are opened.

At the first solid content feeding station S13 and the second solid content feeding station S14, the solid content feeding step is performed by the solid content feeding devices 13 to introduce contents (in particular, solid contents) into the inside of bags B gripped by the respective gripper pairs 21*a*, via the mouth portions of the bags B. At the first liquid introduction station S15 and the second liquid introduction station S16, the liquid introduction step is performed by the liquid introduction devices 14 to introduce a content (in particular, a liquid) into the inside of bags B.

At the first solid content feeding station S13 and the second solid content feeding station S14, the same type of solids may be fed into the inside of bags B as each other or different types of solids may be fed into the inside of bags B as each other. Likewise, at the first liquid introduction station S15 and the second liquid introduction station S16, the same type of liquid may be introduced into the inside of bags B as each other or different types of liquid may be introduced into the inside of bags B as each other. In a case where the same type of solid/liquid is fed into the inside of each bag B at a plurality of stations, even if the intermittent stop time of each gripper pair 21*a* and each bag B at each station is short, the desired amount of solid/liquid can be introduced into each bag B, thus reducing the overall processing time of the system.

At the first sealing station S18 and the second sealing station S19, the sealing process is performed by the first sealing device 16 and the second sealing device 17 in such a manner that the mouth portion of each bag B is sealed. At the cooling release station S20, a cooling process is performed by the cooling device 18 to cool the sealed part of each bag B and then a release process is performed by the bag release device 19 to send each bag B downstream.

In the example shown in FIGS. 4 and 5, the movement path of each gripper pair 21*a* and each bag B includes two straight paths and two semicircular (circular arc) paths (i.e., non-straight paths) connecting the ends of the two straight paths. The bag feeding station S11, the mouth opening station S12, the degassing station S17, the first sealing station S18, the second sealing station S19 and the cooling release station S20 are provided along one of the straight paths. The first solid content feeding station S13, the second solid content feeding station S14, the first liquid introduction station S15 and the second liquid introduction station S16 are provided along the other of the straight paths.

None of the stations is provided along the semicircular paths. Consequently, at the respective stations S11 to S20, various types of processing can be performed in a state where the influence of centrifugal force that each gripper pair 21*a* and each bag B receive while each gripper pair 21*a* and each bag B move on the non-straight paths is reduced. In the semicircular path between the second liquid introduction station S16 and the degassing station S17, the sway suppression guide 28 which suppresses the sway of a bag B supported by each gripper pair 21*a* due to centrifugal force is installed.

Next, an example of shaking control of a liquid L in a bag B is described.

Figure 6:
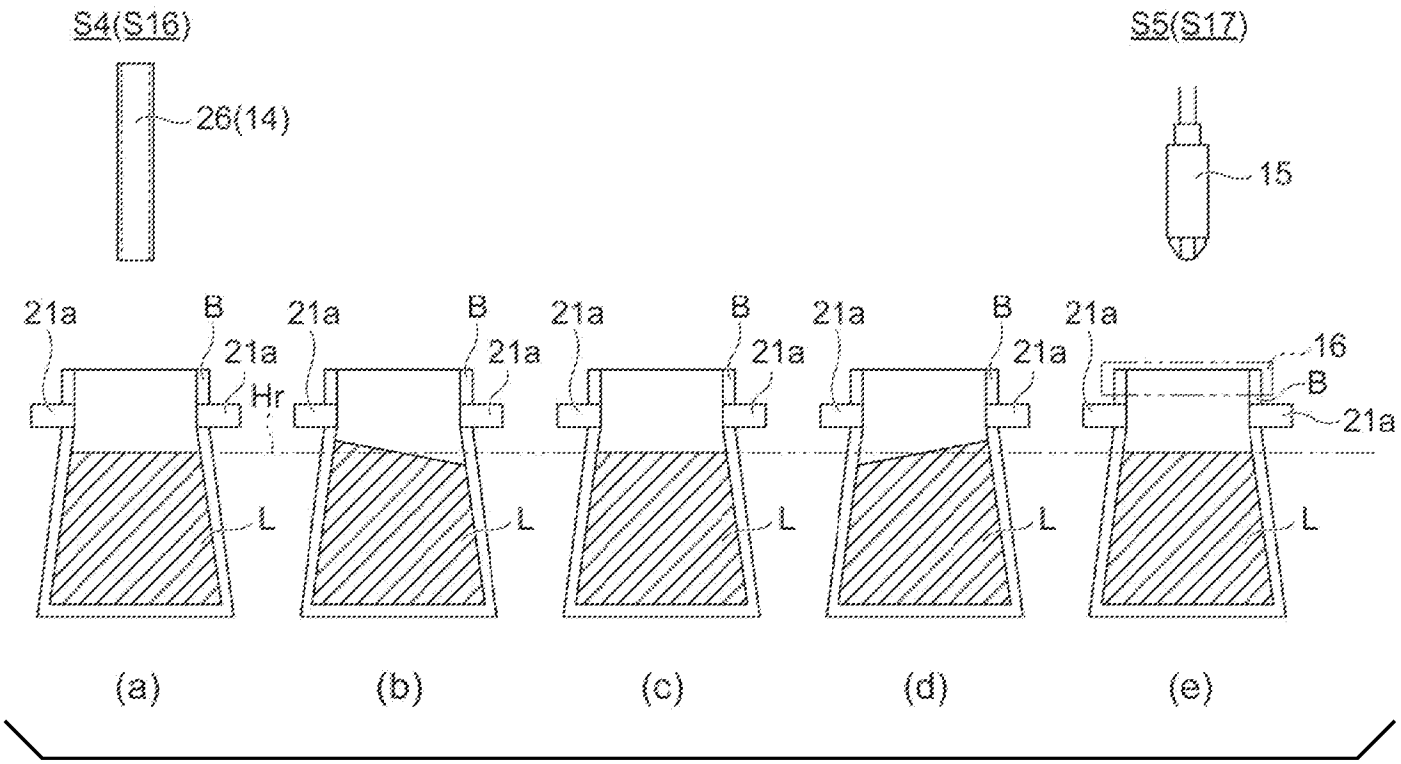
FIG. 6 is a diagram showing an example of the state of a liquid in a bag over time when a bag acceleration/deceleration control based on an embodiment of the present disclosure is performed.
Figure 7:
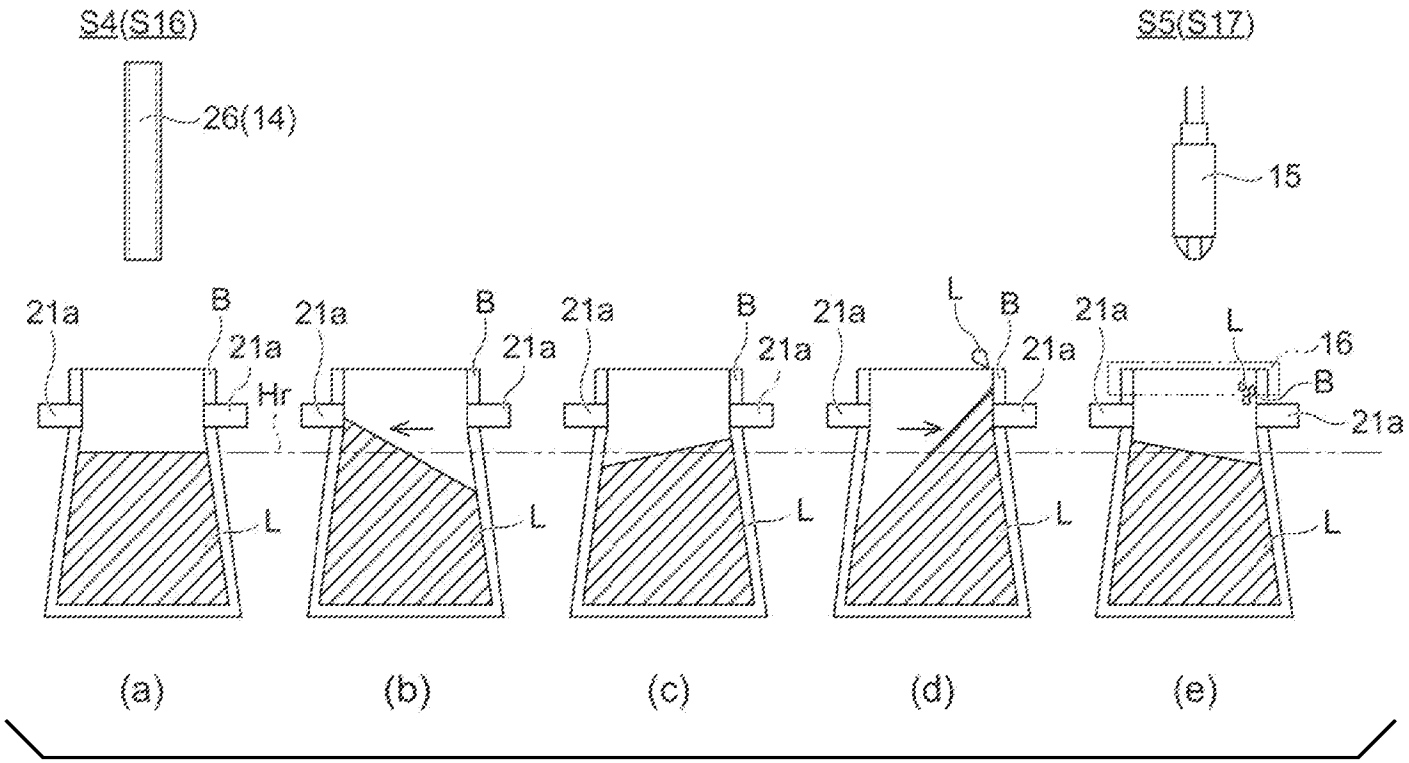
FIG. 7 is a diagram showing an example of the state of a liquid in a bag over time when a bag acceleration/deceleration control based on an embodiment of the present disclosure is not performed.

FIG. 6 is a diagram showing an example of the state of a liquid L in a bag B over time when a bag acceleration/deceleration control based on an embodiment of the present disclosure is performed. FIG. 7 is a diagram showing an example of the state of a liquid L in a bag B over time when a bag acceleration/deceleration control based on an embodiment of the present disclosure is not performed.

In FIGS. 6 and 7, one bag B of a plurality of bags B transferred by the plurality of gripper pairs 21*a* is paid attention to and a case where the bag B is moved from the liquid introduction station S4 to the degassing station S5 is shown. Even while a bag B moves from the second liquid introduction station S16 shown in FIG. 4 to the degassing station S17, the liquid L in the bag B shows a basically similar behavior as that shown in FIG. 6. Further, even while a bag B moves between other stations (e.g., from the degassing station S5 to the bag release station S9 shown in FIG. 1 and from the degassing station S17 to the cooling release station S20), the liquid in the bag B shows a basically similar behavior as that shown in FIG. 6.

In the present embodiment, when a bag B moves between adjacent stations, the gripper pair 21*a* and the bag B are subjected to an intermittent stop step (see "(a)" shown in FIG. 6), an acceleration step (see "(b)" shown in FIG. 6), a constant speed step (see "(c)" shown in FIG. 6), a deceleration step (see "(d)" shown in FIG. 6) and an intermittent stop step (see "(e)" shown in FIG. 6). In other words, an intermittent movement step between the intermittent stop steps includes the acceleration step (see "(b)" shown in FIG. 6), the constant speed step (see "(c)" shown in FIG. 6) and the deceleration step (see "(d)" shown in FIG. 6).

At the liquid introduction station S4, after the injection of a liquid L from an injection nozzle 26 of the liquid introduction device 14 into a bag B is completed, the liquid level of the liquid L in the bag B in a stopped state is basically at a reference liquid level position Hr (see "(a)" shown in FIG. 6). In reality, the liquid L in the bag B may swing and in such a case, the liquid level of the liquid L in the bag B moves up and down with respect to the reference liquid level position Hr.

In the acceleration step (see "(b)" shown in FIG. 6) in which a gripper pair 21*a* and a bag B gradually accelerate, due to inertia, the liquid level of the liquid L in the bag B on the movement direction side (i.e., on the right side in "(b)" of FIG. 6) is lowered below the reference liquid level position Hr while the liquid level of the liquid L in the bag B on the opposite side to the movement direction (i.e., on the left side in "(b)" of FIG. 6) is raised above the reference liquid level position Hr. Thus, during the acceleration step, the liquid L in the bag B approaches the mouth portion of the bag B (i.e., the upper edge part in "(b)" of FIG. 6) on the opposite side to the movement direction.

Then, in the constant speed step (see "(c)" of FIG. 6) in which a gripper pair 21*a* and a bag B are transferred at a constant speed, the liquid level of the liquid L in the bag B is entirely located at the reference liquid level position Hr or moves up and down regularly with respect to the reference liquid level position Hr.

Then, in the deceleration step (see "(d)" of FIG. 6) in which a gripper pair 21*a* and a bag B are decelerated, due to inertia, the liquid level of the liquid L in the bag B on the movement direction side (i.e., on the right side in "(d)" of FIG. 6) is raised above the reference liquid level position Hr while the liquid level of the liquid L in the bag B on the opposite side to the movement direction (i.e., on the left side in "(d)" of FIG. 6) is lowered below the reference liquid level position Hr. Thus, during the deceleration step, the liquid L in the bag B approaches the mouth portion of the bag B (i.e., the upper edge part in "(d)" of FIG. 6) on the movement direction side.

Then, when a gripper pair 21*a* and a bag B are stopped at the degassing station S5, the liquid level of the liquid L in the bag B is entirely located at the reference liquid level position Hr or moves up and down regularly with respect to the reference liquid level position Hr (see "(e)" of FIG. 6).

In the sequence of processes ("(a)" to "(e)" of FIG. 6) described above (in particular, during the acceleration of a gripper pair 21*a* and a bag B ("(b)" of FIG. 6) and/or during the deceleration of a gripper pair 21*a* and a bag B ("(d)" of FIG. 6)), the conveyance control device 30 (see FIG. 2) controls the conveyance drive device 22 to accelerate and decelerate the plurality of gripper pairs 21*a* in such a manner that the shaking of the liquid L in bags B is reduced. As a result, it is possible to prevent the liquid L in the bags B from unintentionally adhering to the mouth portions of the bags B (e.g., to the parts to be sealed) and from unintentionally splashing out of the bags B.

The specific method of acceleration and deceleration of the plurality of gripper pairs 21*a* such that the shaking of the liquid L in bags B is reduced is not limited.

For example, if the liquid L in a bag B is shaking at the liquid introduction station S4, the shaking of the liquid L in the bag B can be reduced by starting the acceleration of the gripper pair 21*a* and the bag B at the timing when the shaking of the liquid L is made to be reduced. Specifically, by accelerating the gripper pair 21*a* and the bag B while the liquid level of the liquid L in the bag B is rising on the movement direction side or immediately before the liquid level of the liquid L in the bag B starts to rise on the movement direction side, it is possible to, in the acceleration step, reduce the degree of rise of the liquid level of the liquid L on the opposite side to the movement direction.

Likewise, if the liquid L in a bag B is shaking in the constant speed step (see "(c)" of FIG. 6), the shaking of the liquid L in the bag B can be reduced by starting the deceleration of the gripper pair 21*a* and the bag B at the timing when the shaking of the liquid L is made to be reduced. Specifically, by decelerating the gripper pair 21*a* and the bag B while the liquid level of the liquid L in the bag B is rising on the opposite side to the movement direction or immediately before the liquid level of the liquid L in the bag B starts to rise on the opposite side to the movement direction, it is possible to, in the deceleration step, reduce the degree of rise of the liquid level of the liquid L on the movement direction side.

As shown in FIG. 7, if a gripper pair 21*a* and a bag B are decelerated in a state where the liquid L in the bag B is shaking in the constant speed step (see "(c)" of FIG. 7) while the liquid level of the liquid L in the bag B is rising on the movement direction side, the shaking due to the deceleration occurs, in addition to the original shaking, in the liquid L in the bag B in a superimposed manner. As a result, the liquid L in the bag B rises significantly on the movement direction side and may adhere to the mouth portion of the bag B (in particular, to the part to be sealed) or may fly out of the mouth portion of the bag B (see "(d)" of FIG. 7).

As described above, by accelerating or decelerating the plurality of gripper pairs 21*a* according to the state of shaking of the liquid L in the bags B, the shaking of the liquid L in the bags B can be reduced. The state of shaking of the liquid L in a bag B may be detected in real time by a sensor which is not shown in the drawings, may be deduced based on the state of shaking of the liquid L in the bag B detected beforehand by a sensor, or may be deduced based on the state of shaking of the liquid L in the bag B perceived by an operator through observation in advance. In a case where the plurality of gripper pairs 21*a* are accelerated or decelerated based on the state of shaking of the liquid L deduced in advance by a sensor or an operator, the acceleration start timing, the constant speed start timing, the deceleration starts timing and the stop timing for the plurality of gripper pairs 21*a* can be determined in advance. Therefore, the conveyance control device 30 may control the conveyance drive device 22 to perform the acceleration or deceleration of the plurality of gripper pairs 21*a* at a timing determined in advance.

The "method of accelerating and decelerating a plurality of gripper pairs 21*a* so as to reduce the shaking of the liquid L in bags B" is not limited to the above-described example. For example, by accelerating or decelerating the gripper pairs 21*a* and the bags B in accordance with an arbitrary manner that follows the principle of Input Shaping, the shaking of the liquid L in the bags B can be reduced.

The principle of Input Shaping is achieved by applying a force to a liquid so as to reduce (cancel) the shaking of the liquid immediately before, so that the shaking of the liquid is reduced (cancelled). When the plurality of gripper pairs 21*a* are accelerated or decelerated to reduce the shaking of the liquid L in the bags B, the magnitude and acting duration (i.e., impulse) of force acting on the liquid L in the bags B (e.g., of inertia force) are preferably determined also in consideration of the natural frequency and the damping ratio of the gripper pairs 21*a* (the support units 21) supporting the bags B.

Therefore, during a single intermittent movement step, there may be two or more acceleration steps, may be two or more deceleration steps, and may be no constant speed step. In each acceleration step, by starting the acceleration of the gripper pairs 21*a* and the bags B while the liquid level of the liquid L in the bags B on the movement direction side is rising or just before the liquid level of the liquid L in the bags B on the movement direction side starts to rise, the degree of rise of the liquid level of the liquid L on the opposite side to the movement direction can be suppressed. On the other hand, in each deceleration process, by starting the deceleration of the gripper pairs 21*a* and the bags B while the liquid level of the liquid L in the bags B on the opposite side to the movement direction is rising or just before the liquid level of the liquid L in the bags B on the opposite side to the movement direction starts to rise, the degree of rise of the liquid level of the liquid L on the movement direction side can be suppressed.

The force acting on the liquid L in each bag B to reduce the shaking of the liquid L immediately before in accelerating or decelerating the plurality of gripper pairs 21*a* as described above, is typically inertial force but may be any other force (e.g., an external force applied instantaneously to the bags B and the liquid L).

As described above, the bag processing system 10 of the present embodiment comprises: a conveyance mechanism 20 which includes a plurality of gripper pairs (support devices) 21*a* being able to support and release bags B and a conveyance drive device 22 moving the plurality of gripper pairs 21*a* intermittently; a liquid introduction device 14 which introduces a liquid L into bags B supported by the plurality of gripper pairs 21*a*; and a conveyance control device 30 which controls the conveyance drive device 22, wherein the conveyance drive device 22 moves the plurality of gripper pairs 21*a* in such a manner that the plurality of gripper pairs 21*a* exhibit the same acceleration-deceleration behavior between each other, and the conveyance control device 30 controls the conveyance drive device 22 to accelerate or decelerate the plurality of gripper pairs 21*a* in such a manner that the shaking of the liquid L in the bags B is reduced.

According to this bag processing system 10, the force (e.g., inertia force) acting on the liquid L in the bags B during the acceleration or deceleration of the gripper pairs 21*a* can be used to reduce the shaking of the liquid L in the bags B, thus effectively suppressing the shaking of the liquid L in the bags B during the bag conveyance. As a result, during the bag conveyance, the liquid L can be effectively prevented from adhering to the mouth portions of the bags B (e.g., to the parts to be sealed) or from splashing out of the mouth portions of the bags B.

Further, by moving the plurality of gripper pairs 21*a* in such a manner that the plurality of gripper pairs 21*a* exhibit the same acceleration-deceleration behavior between each other, the shaking of the liquid L in the plurality of bags B supported by the plurality of gripper pairs 21*a* can be effectively suppressed with an inexpensive device configuration.

Further, at least a part of a movement path of the bags B supported by the plurality of gripper pairs 21*a* includes a non-straight path, and the conveyance control device 30 controls the conveyance drive device 22 to accelerate or decelerate the plurality of gripper pairs 21*a* during the bags B moving in at least a part of the non-straight path in such a manner that the shaking of the liquid L in the bags B is reduced.

A bag B and the liquid L being moving in a non-straight path receive centrifugal force, so that shaking of the liquid L in the bag B tends to increase and become complicated. In the present embodiment even while bags B and the liquid L are moving in a non-straight path, the shaking of the liquid L in the bags B is reduced, so that the magnitude of the shaking of the liquid L in the bags B is suppressed and the complexity of the shaking of the liquid L is also suppressed.

Further, the bag processing system 10 comprises a sway suppression guide 28 which suppresses sway due to centrifugal force of the bags B supported by the plurality of gripper pairs 21*a*.

Thus, the influence of centrifugal force acting on bags B and liquid L can be reduced, thereby reducing the shaking of the liquid L in the bags B and suppressing the complexity of the shaking of the liquid L in the bags B.

Further, the conveyance control device 30 controls the conveyance drive device 22 to intermittently stop the plurality of gripper pairs 21*a* at a plurality of stations S1 to S9 (S11 to S20) in sequence in such a manner that three or more gripper pairs 21*a* are stopped at each of the plurality of stations at a time.

In general, as the number of gripper pairs 21*a* included in each support unit 21 increases, the distance where each gripper pair 21*a* and a bag B move in one intermittent movement step becomes larger and the liquid L in each bag B tends to shake more violently. Even in such a case, according to the bag processing system 10 of the present embodiment, the shaking of the liquid L in a bag B during the bag conveyance can be effectively suppressed.

Various modifications may be added to each element of the above-described embodiments and variations, and the configurations may be partially or entirely combined among the above-described embodiments and variations. Further, the effects produced by the present disclosure are not limited to the effects described above, and particular effects based on the specific configuration of each embodiment may also be produced. As described above, various additions, changes and partial deletions may be made to each element described in the claims, specification and drawings to the extent that they do not depart from the technical concept and the purpose of the present disclosure.

The invention claimed is:

1. A bag processing system comprising:

a conveyor comprising a plurality of grippers being able to support and release bags; and a conveyance actuator configured to move the plurality of grippers intermittently;

a liquid injector configured to introduce a liquid into the bags supported by the plurality of grippers; and a conveyance controller configured to control the conveyance actuator, wherein the conveyance actuator is configured to move the plurality of grippers in such a manner that the plurality of grippers exhibit same acceleration-deceleration behavior between each other, and wherein the conveyance controller is configured to control the conveyance actuator to accelerate or decelerate the plurality of grippers in such a manner that a force that induces shaking of the liquid in the bags is reduced acts on the liquid.

2. The bag processing system as defined in claim 1, wherein at least a part of a movement path of the bags supported by the plurality of grippers includes a non-straight path, and wherein the conveyance controller is configured to control the conveyance actuator to accelerate or decelerate the plurality of grippers during the bags moving in at least a part of the non-straight path in such a manner that shaking of the liquid in the bags is reduced.

3. The bag processing system as defined in claim 1, comprising a sway suppression guide is configured to suppress sway due to centrifugal force of the bags supported by the plurality of grippers.

4. The bag processing system as defined in claim 2, comprising a sway suppression guide is configured to suppress sway due to centrifugal force of the bags supported by the plurality of grippers.

5. The bag processing system as defined in claim 1, wherein the plurality of grippers includes a plurality of gripper portions configured to hold the bags, wherein the conveyance controller is configured to control the conveyance actuator to intermittently stop the plurality of grippers at a plurality of stations in sequence, and wherein three or more grippers are configured to stop at each of the plurality of stations at a time.

6. The bag processing system as defined in claim 2, wherein the plurality of grippers includes a plurality of gripper portions configured to hold the bags, wherein the conveyance controller is configured to control the conveyance actuator to intermittently stop the plurality of grippers at a plurality of stations in sequence, and wherein three or more grippers are configured to stop at each of the plurality of stations at a time.

7. The bag processing system as defined in claim 3, wherein the plurality of grippers includes a plurality of gripper portions configured to hold the bags, wherein the conveyance controller is configured to control the conveyance actuator to intermittently stop the plurality of grippers at a plurality of stations in sequence, and wherein three or more grippers are configured to stop at each of the plurality of stations at a time.

8. The bag processing system as defined in claim 4, wherein the plurality of grippers includes a plurality of gripper portions configured to hold the bags, wherein the conveyance controller is configured to control the conveyance actuator to intermittently stop the plurality of grippers at a plurality of stations in sequence, and wherein three or more grippers are configured to stop at each of the plurality of stations at a time.

* * * * *